US009160097B2

(12) United States Patent
Mori

(10) Patent No.: US 9,160,097 B2
(45) Date of Patent: Oct. 13, 2015

(54) CONNECTOR WITH SMALL HOUSING

(75) Inventor: Shigeo Mori, Makinohara (JP)

(73) Assignee: Yazaki Corporation, Tokyo (JP)

( * ) Notice: Subject to any disclaimer, the term of this patent is extended or adjusted under 35 U.S.C. 154(b) by 47 days.

(21) Appl. No.: 14/002,279

(22) PCT Filed: Feb. 28, 2012

(86) PCT No.: PCT/JP2012/001343

§ 371 (c)(1),
(2), (4) Date: Aug. 29, 2013

(87) PCT Pub. No.: WO2012/120831

PCT Pub. Date: Sep. 13, 2012

(65) Prior Publication Data

US 2013/0330952 A1 Dec. 12, 2013

(30) Foreign Application Priority Data

Mar. 4, 2011 (JP) ..... 2011-047208

(51) Int. Cl.
*H01R 13/52* (2006.01)
*H01R 13/426* (2006.01)
*H01R 107/00* (2006.01)

(52) U.S. Cl.
CPC ..... *H01R 13/52* (2013.01); *H01R 13/426* (2013.01); *H01R 13/521* (2013.01); *H01R 13/5205* (2013.01); *H01R 2107/00* (2013.01); *H01R 2201/26* (2013.01)

(58) Field of Classification Search
CPC ... H01R 13/426; H01R 13/40; H01R 13/4367
USPC ..... 439/733.1
See application file for complete search history.

(56) References Cited

U.S. PATENT DOCUMENTS

| | | | | |
|---|---|---|---|---|
| 5,567,174 | A | 10/1996 | Ericson, Jr. et al. | |
| 2011/0059659 | A1 | 3/2011 | Matsumoto et al. | |
| 2013/0337693 | A1 * | 12/2013 | Mori | 439/626 |

FOREIGN PATENT DOCUMENTS

| | | | |
|---|---|---|---|
| JP | 2010-055809 | A | 3/2010 |
| WO | WO-2010/024362 | A1 | 3/2010 |
| WO | WO 2010024362 | A1 * | 3/2010 |

OTHER PUBLICATIONS

International Search Report and Written Opinion dated May 21, 2012, issued for PCT/JP2012/001343.

* cited by examiner

*Primary Examiner* — Abdullah Riyami
*Assistant Examiner* — Nader J Alhawamdeh
(74) *Attorney, Agent, or Firm* — Locke Lord LLP

(57) ABSTRACT

A connector is provided with a terminal fitting, a housing, a rear holder, a rubber closures, and a spacer provided with a main body shaped cutaway-circular in cross-section, positioning the electric wire connection part and an electric wire therewithin, and two pairs of projections opposing to each other, projecting from inside of the main body where a width K1 of the cutaway is formed smaller than the diameter of the electric wire, and the diametric portion of the electric wire connection part and the electric wire are passed through between the two pairs of projections while the two pairs of projections are enlarged, so as to be positioned within the main body.

3 Claims, 6 Drawing Sheets

CONNECTOR WITH SMALL HOUSING

TECHNICAL FIELD

This invention relates to a connector that composes a wire harness routed in an automobile.

BACKGROUND ART

Various electric devices are mounted on an automobile. In order to transfer power or control signals to such the various electric devises, wire harness is routed in the automobile. The wire harness is composed of a plurality of electric wires and a connector (see PTL 1). FIG. 4 is a cross-sectional view of a conventional connector. FIG. 5 is an exploded view of the connector shown in FIG. 4. FIG. 6 is a prospective view of terminal fittings of the connector shown in FIG. 4.

The above-mentioned connector 301, as shown in FIGS. 4 to 6, is composed of a plurality of terminal fittings 302, a synthetic resin housing having a plurality of terminal housings 314 each accommodating the plurality of terminal fittings 302, a rear holder 304 attached to an end of the housing 302 so as to prevent the terminal fittings 302 from dropping out from the terminal housing 314, a plurality of rubber closures each press-fitted in the terminal housings 314, a plurality of spacers 306 each accommodated in the terminal housings 314, and a plurality of gaskets 307 each attached to the terminal fittings 302. Note that in FIGS. 4 and 5 the terminal fitting 302, the rubber closure 305, the spacer 302, and the gasket 307 are each shown by one, the others of which are not shown.

The above-mentioned terminal fitting 302 is made of conductive metal. The terminal fitting 302 is provided with cylindrical electric contact 311 to be connected with a terminal fitting of not-shown mating connector, a cylindrical electric wire connection part 310 connected with a core wire of the electric wire 308. The electric wire connection part 310 is provided with an annular flange 312 projecting from outside thereof so as to be contactable with a step face 317 disposed in the terminal housing 314. The electric contact 311, the electric wire connection part 310 and the flange 312 are concentrically arranged.

The electric contact 311 is formed elastically such that its inner or outer diameter is allowed to enlarge or shrink, inside which the terminal fitting of the mating connector is inserted, so as to elastically deformed, resulting in electrically connecting with the terminal fitting of the mating connector.

The above-mentioned electric wire connection part 310 is electrically connected with the core wire 309 of the electric wire 308 by the core wire 309 of the electric wire 308 being inserted therewithin so as to be plastically deformed such that its inner or outer diameter shrinks, i.e., swaged. The above-mentioned flange 312 is disposed at an end near the electric contact 311 of the electric wire connection part 310. Outside of the flange 312 is provided with a recess 313 across its whole circumference.

Each the above-mentioned terminal housing 314 is a space straightly extending. Each the terminal housing 314 is provided with: a first housing 315 accommodating an electric wire connection part 310, an end of the electric wire 308 connected with the electric wire connection part 310, a rubber closer 305 attached to outside of the electric wire 308, and a spacer 306; a second housing 316 extending to the first housing 315; and a step face 317 formed between the first housing 315 and the second housing 316. The first housing 315 and the second housing 316 are formed circular in cross-section. The second housing 316 is formed such that its inner diameter is arranged smaller than that of first housing 315. A left end in the left side in FIG. 4 of the housing 303 according to the aforementioned configuration is engaged with a housing of the not-shown mating connector.

The above-mentioned rear holder 304 is attached to an end of a side away from the mating connector in the housing 303. The rear holder 304 is provided with a plurality of through holes 318 receiving the electric wire 308 therewithin attached to the terminal fitting 302.

The above-mentioned rubber closure 305 is composed of a gasket 319 annularly formed of elastic synthetic resin such as rubber, and an infilling member 320 made of synthetic resin that is harder and less elastic than the gasket 319. The rubber closure 305 is press-fitted into the first housing 315 with the electric wire 308 therethrough so as to waterproof between outside of the electric wire 308 and inside of the first housing 315.

The above-mentioned spacer 306 is formed cylindrical such that its cross-sectional circle is partially cut away. The spacer 306 is accommodated in the first housing 315 while the electric wire connection part 310 and the electric wire 308 are positioned therewithin and are arranged between the flange 312 and the rubber closure 305. A width of a cutaway of the spacer 306 is formed larger than a diameter of the electric wire connection part310 and the electric wire 308.

The above-mentioned gasket 307 is annularly formed of elastic synthetic resin such as rubber, and is attached to the flange 312 in such a manner as to be accommodated in the recess 313. It is made possible that the gasket 307 waterproofs between outside of the flange 312 and inside of the first housing 315.

The connector 301 according to the aforementioned configuration is assembled as follows. Firstly, the terminal fitting 302 is attached to the gasket 307, and the electric wire 308 is passed through the rubber closure 305. Secondly, the core wire 309 of electric wire 308 is inserted into the electric wire connection part 310, and the electric wire connection part 310 is swaged such that the electric wire 308 is attached to the terminal fitting 302. Then, while spacer 306 being sandwiched between the flange 312 and the rubber closure 305, the terminal fitting 302, the gasket 307, the spacer 306, the rubber closure 305, and the electric wire 308 are inserted into the terminal housing 314. Lastly, the rear holder 304 is attached to the housing 303, completing the aforementioned connector 301. The connector 301 assembled in this way is engaged with the mating connector, composing the wire harness that is routed in the automobile.

It is made possible that such the connector 301 fixes the terminal fitting 302 to the housing 303 by the flange 312 that is contactable with the step face 317 of the terminal housing 314, and by the spacer 306 arranged between the flange 312 and the rubber closure 305 without providing within the housing 303 a lock arm locking in terminal fitting 302.

CITATION LIST

Patent Literature

[PTL 1]
Japanese Patent Application Laid-Open Publication No. 2010-55,809

SUMMARY OF INVENTION

Technical Problem

With the above-mentioned conventional connector 301, there has, however, been a drawback as will hereafter be discussed. Namely, because the spacer 306 in the connector 301 is formed cylindrical such that its cross-sectional circle is partially cut away, and thereby the spacer 306, when assembling each components to the housing 303, easily drop out, the connector 301 has contained a drawback of poor assembling workability.

Accordingly, an object of the invention is to provide a connector that is allowed to prevent the components from dropping out when assembling each components to the housing, and thereby to improve the assembling workability.

Solution to Problem

In order to attain the above-mentioned object, there is provided a connector according to the present invention recited in claim 1 characterized by comprising: (a) a terminal fitting provided with an electric contact adapted to be connected with a mating terminal fitting and an electric wire connection part connected with an electric wire, the electric wire connection part having a flange projecting from outside of the electric wire connection part; (b) a housing provided with a terminal housing accommodating the terminal fitting, the terminal housing having (i) a first housing accommodating the electric wire connection part, an end of the electric wire connected with the electric wire connection part; (ii) a second housing extending to the first housing; and (iii) a step face formed between the first housing and the second housing, wherein the electric wire connection part is contactable with the step face; (c) a rear holder attached to an end of the housing so as to prevent the terminal fitting from dropping out from the terminal housing; (d) a rubber closure attached to outside of the electric wire and press-fitted into the terminal housing; and (e) a synthetic resin spacer accommodated in the first housing of the terminal housing, the spacer being arranged between the flange and the rubber closure, and including (i) a main body shaped circular in cross-section and positioning the electric wire connection part and the electric wire therewithin, and (ii) at least a pair of projections projecting from inside of the main body and opposing to each other, a space between the at least pair of projections being formed narrower than a diameter of the electric wire, and diametrical portions of the electric wire connection part and the electric wire being positioned within the main body in an assembly state in such a manner that the diametrical portions of the electric wire connection part and the electric wire are passed through between the at least pair of projections while the space between the at least pair of projections is broadened.

According to the present invention recited in claim 2, there is provided a connector as claimed in claim 1 characterized by further comprising a gasket attached to outside of the flange and water-proofing between outside of the flange and inside of the first housing.

Advantageous Effects of Invention

According to the present invention recited in claim 1, since the spacer is provided with a cross-sectionally circular main body positioning the electric wire connection part and the electric wire therewithin, and at least a pair of projections projecting from inside surface of the main body and opposing to each other, a space between the pair of projections is formed smaller than a diameter of the electric wire, and diametrical portions of the electric wire connection part and the electric wire are passed through between the pair of projections with a space of the at least pair of projections being broadened and are assembled to be positioned within the main body, it is made possible that the spacer drops out when assembling each component to the housing, whereas the conventional one would easily drop out. Thereby, there is provided a connector with good assembly workability preventing dropout of the components when assembling each the component to the housing.

According to the present invention recited in claim 2, since the connector further comprises a gasket attached to outside of the flange and waterproofing between outside of the flange and inside of the first housing, there is provided a waterproof connector.

DESCRIPTION OF EMBODIMENTS

A connector according to one embodiment of the present invention will be discussed with reference to FIGS. 1 to 3.

Figure 1:
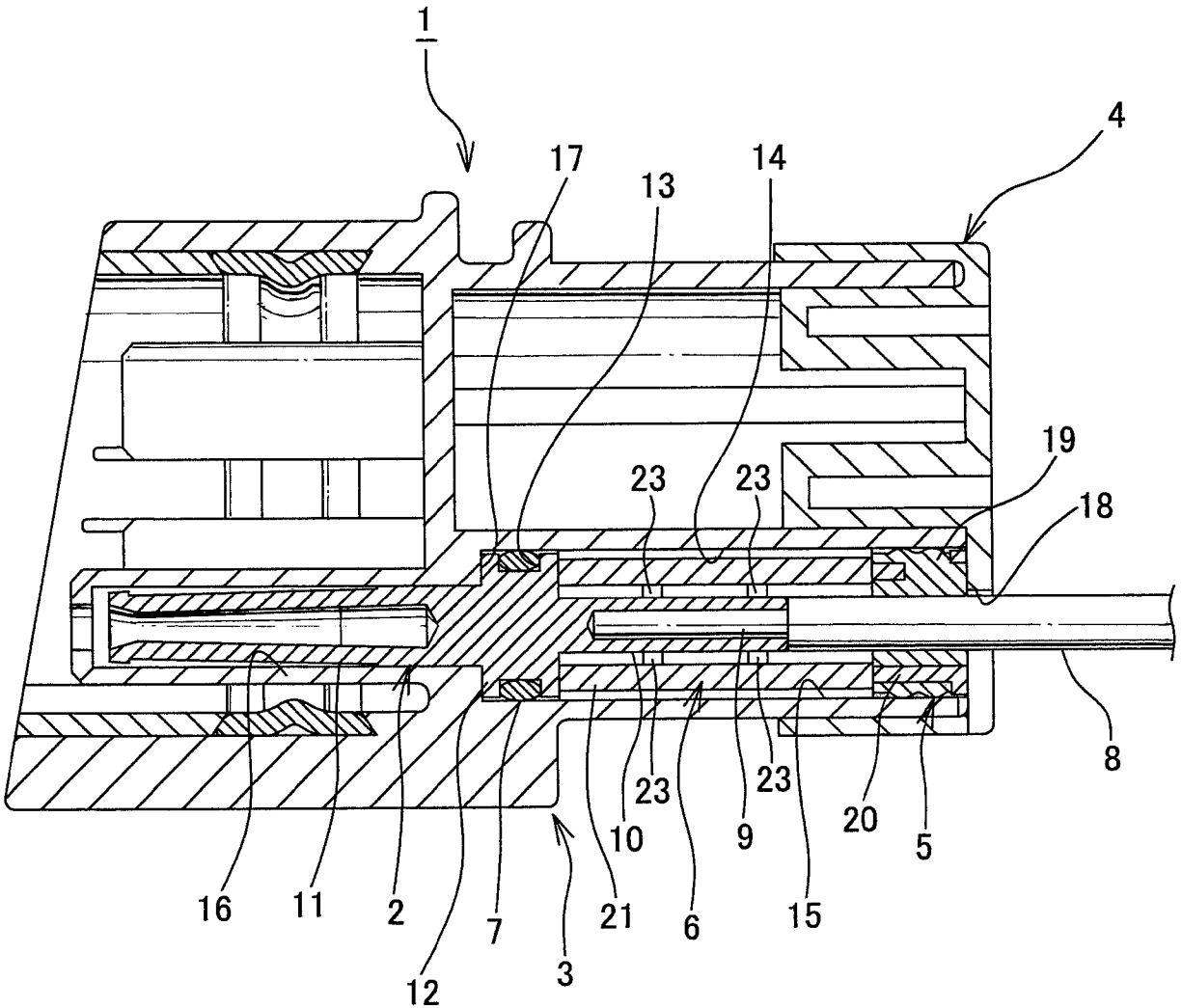
FIG. 1 is a cross-sectional view illustrating a connector according to one embodiment of the present invention.
Figure 2:
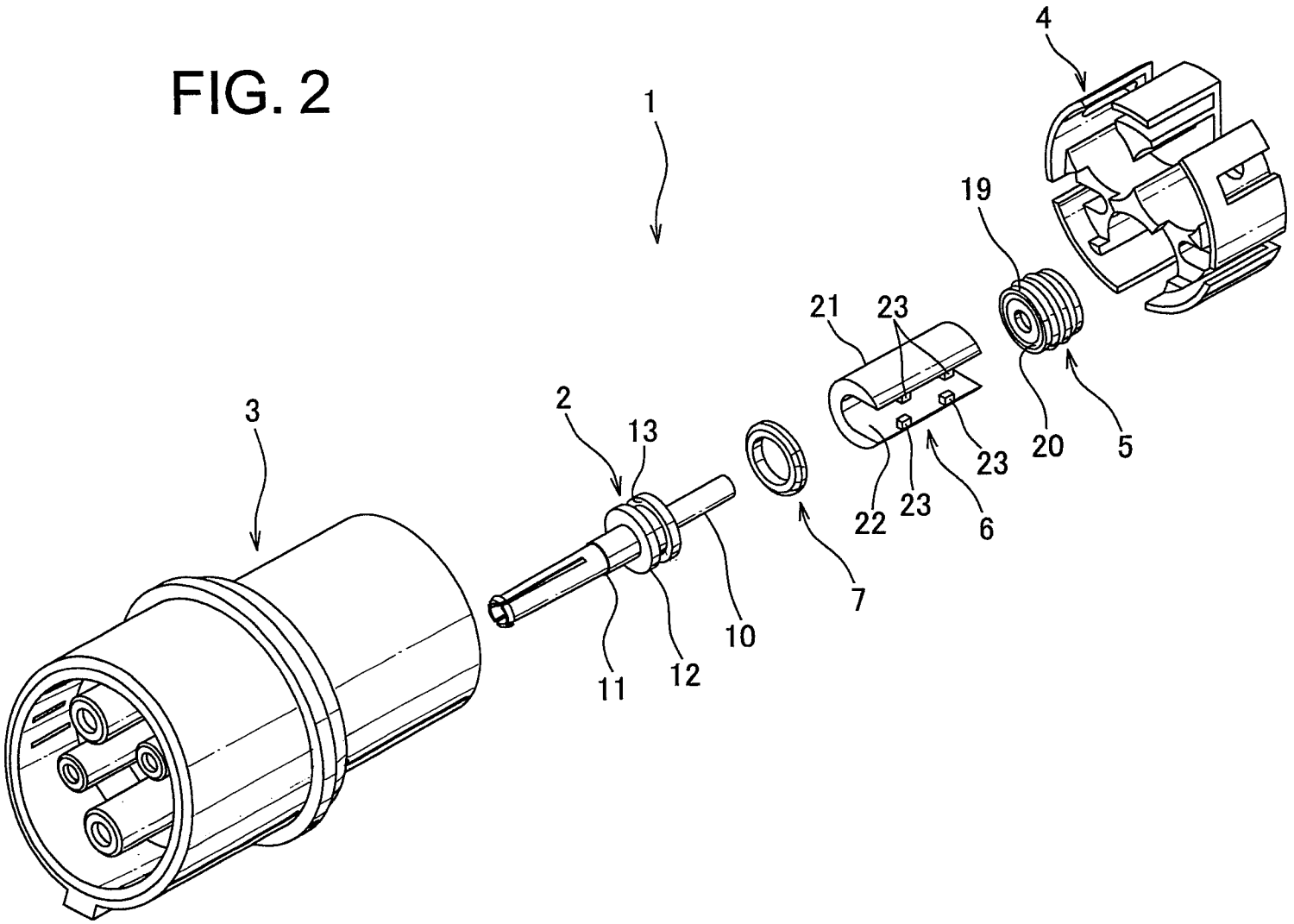
FIG. 2 is an exploded view illustrating the connector shown in FIG. 1.

A connector 1 as shown in FIGS. 1, 2, is provided with a plurality of terminal fitting 2, a synthetic resin housing 3 provided with a plurality of terminal housings 14 each accommodating the plurality of terminal fittings 2, a rear holder 4 preventing the terminal fittings 2 attached to an end of the housing 3 from dropping out from a terminal housing 14, a plurality of rubber closures 5 press-fitted into each terminal housing 14, a plurality of synthetic resin spacers 6 each accommodated in the terminal housing 14, and a plurality of gaskets 7 each attached to the terminal fittings 2. Note that in FIGS. 1 and 2, the terminal fittings 2, the rubber closure 5, the spacer 6, and the gasket 7 are shown by one, the others of which are omitted.

The aforementioned terminal fittings 2 are made of conductive metal. The terminal fittings 2 are provided with a cylindrical electrical contact 11 to be connected with not-shown terminal fittings of a mating connector, a cylindrical electric wire connection part 10 a core wire 8 of the electric wire 8 is connected with. The electric wire connection part 10 is provided with an annular flange 12 contactable with a step face 17 that is disposed in the terminal housing 14. The electric contact 11, the electric wire connection part 10, and the flange 12 are arranged coaxial. The electric wire 8 is provided with the core wire 9 and an isolation cover, and is formed circular in cross-section.

The aforementioned electric contact 11 is formed flexible so that its inner or outer diameter is allowed to enlarge or shrink, and is thereby electrically connected with the terminal fittings of the mating connector by flexible deformation when receiving the terminal fittings of the mating connector therewithin.

The above-mentioned electric wire connection part 10 is electrically connected with the core wire 9 of the electric wire 8 by the core wire 9 of the electric wire 8 being inserted therewithin and being plastically deformed such that outer and inner diameter thereof is shrunk, i.e., swaged. The above-mentioned flange 12 is disposed at an end near the electric contact 11 of the electric wire connection part 10. Outside of the flange 12 is provided with a recess 13 across its whole circumference.

Each the above-mentioned terminal housing 14 is a space straightly extending. Each the terminal housing 14 is provided with: a first housing 15 accommodating an electric wire connection part 10, an end of the electric wire 8 connected with the electric wire connection part 10, the rubber closure 5 attached to outside of the electric wire 8, and the spacer 6; a second housing 16 extending to the first housing 15; and a step face 17 formed between the first housing 15 and the second housing 16. The first housing 15 and the second housing 16 are formed circular in cross-section. The second housing 16 is formed such that its inner diameter is arranged smaller than the inner diameter of the first housing 15 and the outer diameter of the flange 12. A left end in the left side in FIG. 1 of the housing 3 according to the aforementioned configuration is engaged with a housing of the not-shown mating connector.

The above-mentioned rear holder 4 is attached to an end of a side away from the mating connector in the housing 3. The rear holder 4 is provided with a plurality of through holes 18 receiving the electric wire 8 therewithin attached to the terminal fitting 2.

The above-mentioned rubber closure 5 is as shown in FIG. 1, composed of a gasket 19 formed annular and made of elastic synthetic resin such as rubber, and an infilling member 20 made of synthetic resin that is arranged harder and less elastic than the gasket 19. The rubber closure 5 is press-fitted into the first housing 15 with the electric wire 8 therethrough so as to waterproof between outside of the electric wire 8 and inside of the first housing 15.

The above-mentioned spacer 6 is provided with a main body 21 shaped cutaway-circular in cross-section, positioning the electric wire connection part 10 and the electric wire 8 therewithin, and two pairs of projections opposing to each other, projecting from inside of the main body 21. Note that the aforementioned "cutaway-circular in cross-section" is called such a cross-sectional shape as a partially cutaway ring, i.e., C-shape in cross-section. The cutaway is marked as reference sign 22. Namely, the main body 21 is formed cylindrical with the cutaway 22. This cutaway 22 extends in an axial direction of the cylinder, and along across the cylinder. The two pairs of projections 23 are provided near the cutaway 22. Namely, the two pairs of projections 23 are disposed nearer the cutaway 22 than a diametric portion of the main body 21. A width K1 of the cutaway 22 in such a state that the main body 21 is not bent as shown in FIG. 3 is formed broader than a diameter of the electric wire connection part 10 and the electric wire 8, a space between the two pairs of projections 23 narrower than the diameter of the electric wire connection part 10 and the electric wire 8.

Figure 3:
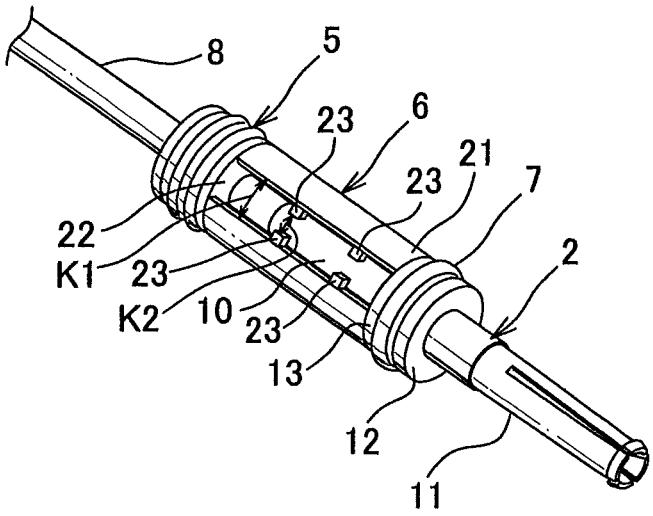
FIG. 3 is a perspective view illustrating a terminal fitting and the like of the connector shown in FIG. 1.
Figure 4:
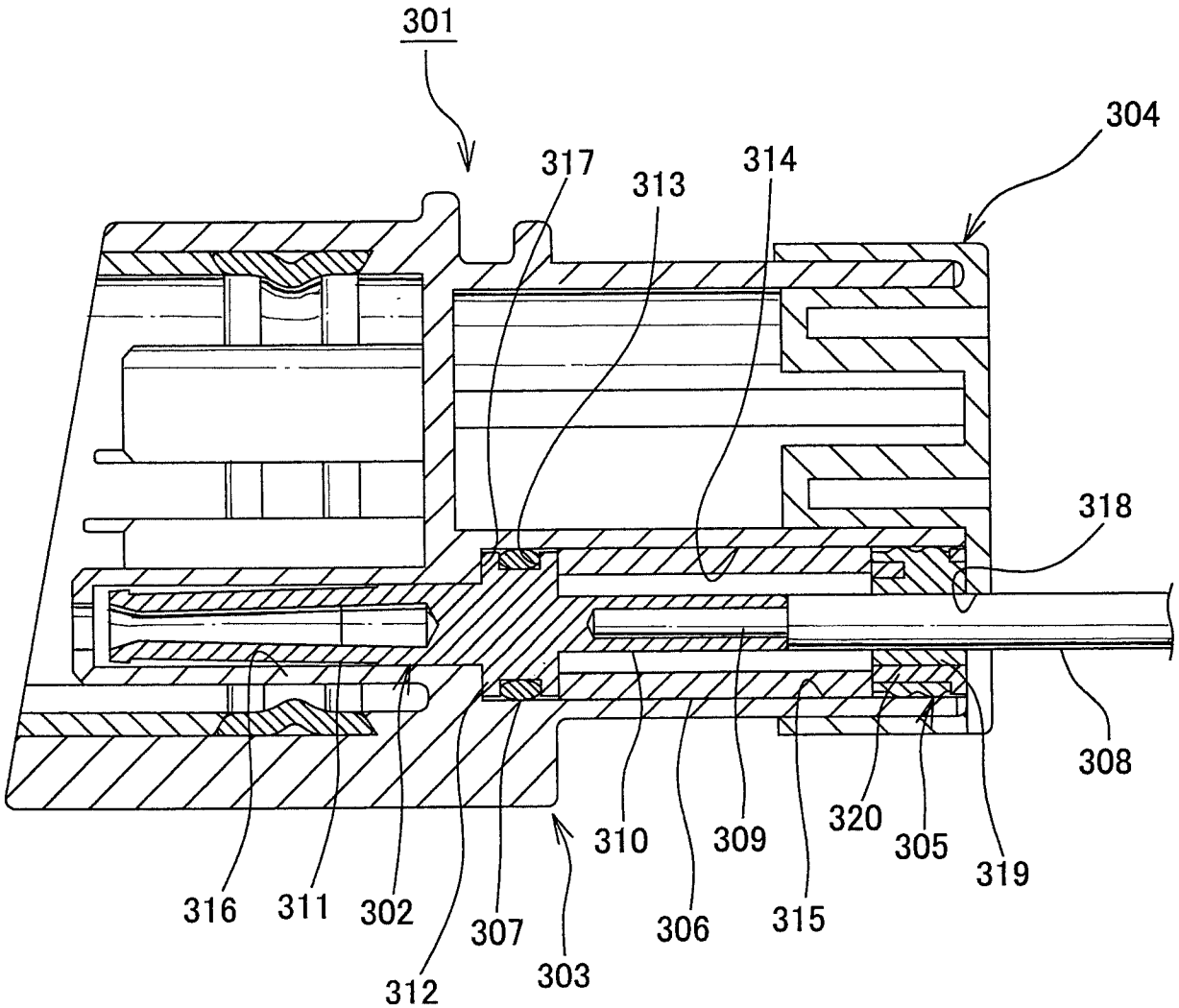
FIG. 4 PRIOR ART
FIG. 4 is a cross-sectional view illustrating a conventional connector.
Figure 5:
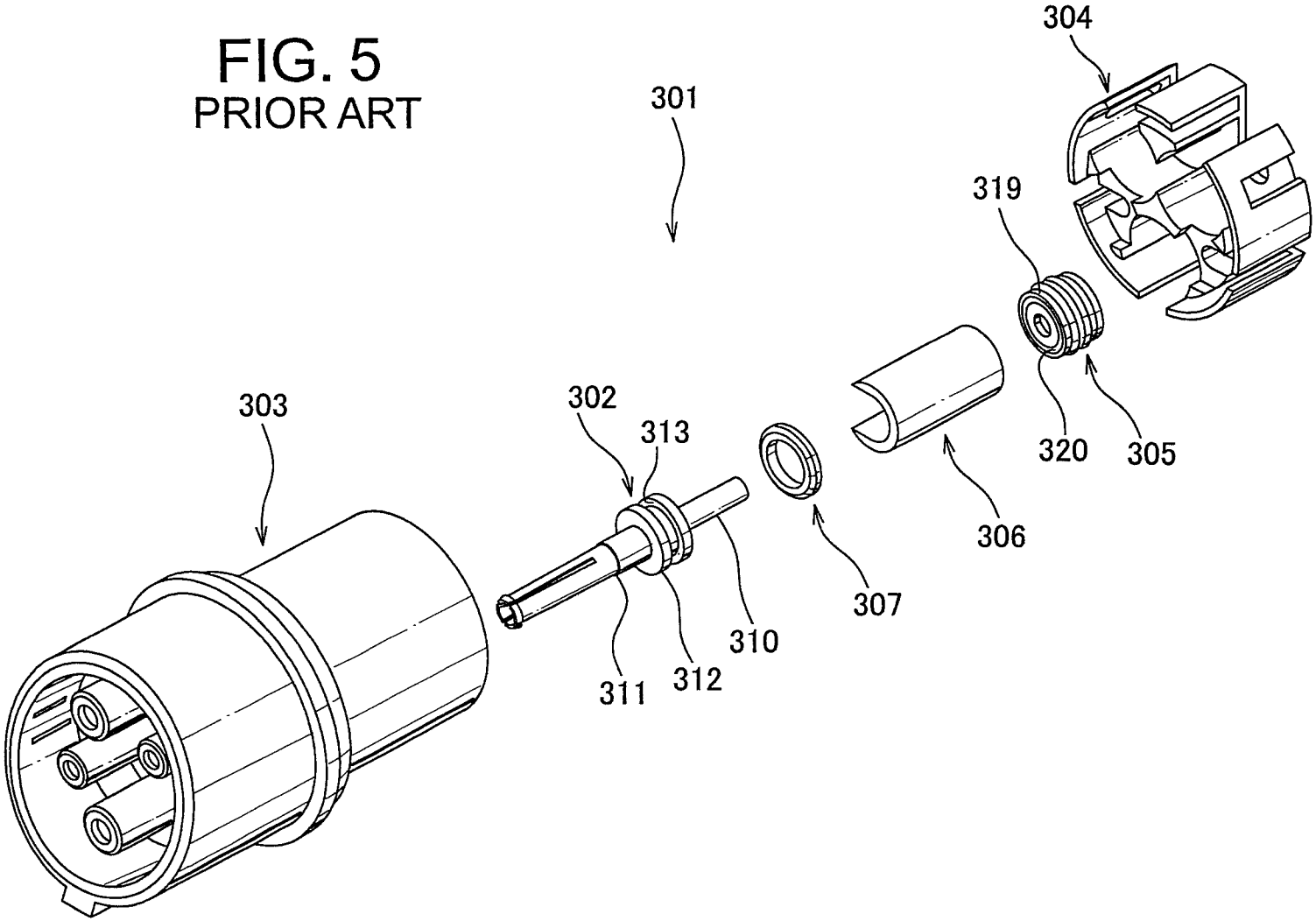
FIG. 5 PRIOR ART
FIG. 5 is an exploded view illustrating the connector shown in FIG. 4.
Figure 6:
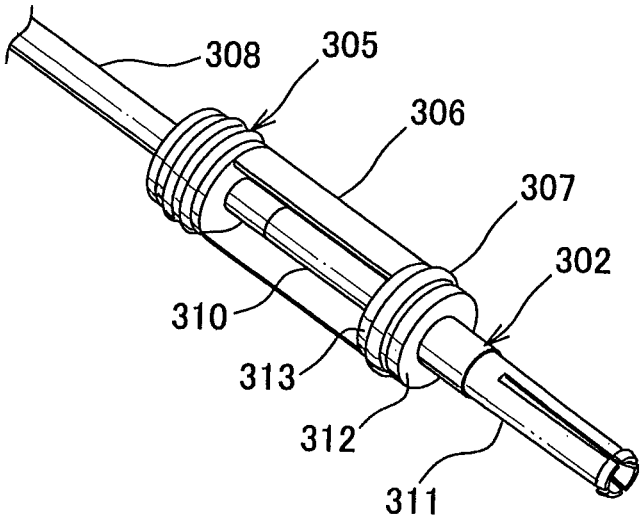
FIG. 6 PRIOR ART
FIG. 6 is a perspective view illustrating the terminal fitting of the connector shown in FIG. 4.

The electric wire connection part 10 and the electric wire 8 shown in FIG. 3 are passed through between the cutaway 22 and the two pairs of projections 23 so as to be positioned within the main body 21. Furthermore, the electric wire connection part 10 and the electric wire 8 are passed through between the two pairs of projections 23 while the space of the two pairs of projections 23 is enlarged. Namely, the spacer 6 is elastically deformed in such a way that the space between the two pairs of projections is enlarged while the electric wire connection part 10 and the electric wire 8 are passed through the two pairs of projections 23, and is restored as is before elastic deformation after passed through therebetween, which prevents the electric wire connection part 10 and the electric wire 8 from moving toward outside of the main body 21. Namely, the connector 1 is assembled in such a manner that the diametric portion of the electric wire connection part 10 and the electric wire 8 is passed through between the two pairs of projections 23 while the two pairs of projections 23 is enlarged, so as to be positioned within the main body 21.

Such the spacer 6 is arranged between the flange 12 and the rubber closure 5 in the first housing 15. In this state the electric wire connection part 10 and the end of the electric wire 8 are positioned inside of the main body 21, and both ends of the main body 21 each abut the flange 12 and the rubber closure 5. In this state, the flange 12 abuts the step face 17, the rubber closure 5 the rear holder 4.

The connector 1 according to the present invention is so preferable that the flange 12 also abuts the step face 17, the rubber closure 5 the rear holder 4, but it may also be allowed that slight space is induced between the flange 12 and the step face 17, as well as between the rubber closure 5 and the rear holder 4 by dimension variability within tolerance of each components.

It is made possible that the connector 1 according to the present invention fixes the terminal fittings 2 to the housing 3 by the spacer 6 and the flange 6 capable of abutting the step face 17 of the terminal housing 14 without providing with the housing 3 a lock arm locked in the terminal fittings 2. It is thereby made possible to downsize the housing 3 by adapting this configuration.

The aforementioned gasket 7 is formed annular and made of elastic synthetic resin such as rubber, and is attached to the flange 12 in such a manner as to be accommodated in the recess 13. The gasket 7 waterproofs between outside of the flange 12 and inside of the first housing 15.

The connector 1 according to the aforementioned configuration is assembled as follows. Firstly, the terminal fitting 2 is attached to the gasket 7, and the electric wire 8 is passed through the rubber closure 5. Secondly, the core wire 9 of electric wire 8 is inserted into the electric wire connection part 10, and the electric wire connection part 10 is swaged such that the electric wire 8 is attached to the terminal fitting 2. Then, the spacer 6 is attached to outside of the electric wire connection part 10 and the electric wire 8, and the rubber closure 5 is displaced toward the flange 12 such that the both ends of the main body 12 each abut the flange 12 and the rubber closure 5. The sate at this time is shown in FIG. 3. Then, the terminal fitting 2, the gasket 7, the spacer 6, the rubber closure 5, and the electric wire 8 are introduced into the terminal housing 14. Finally, the rear holder 4 is attached to the housing 3, completing the aforementioned connector 1. The connector 1 as assembled in this way, e.g., to engage with the mating connector composes the wire harness routed in the automobile.

Since such the connector 1 is provided with the two pairs of projections 23 in the spacer 6, it is made possible that the spacer 6, when assembling each components to the housing 3, is prevented from dropping out from between the flange 12 and the rubber closure 5, and that the connector 1 is readily assembled. Furthermore, it is made possible that the connector 1 waterproofs the end of the electric wire 8 by the rubber closure 5 and the gasket 7, and fixes the terminal fittings 2 to the housing 3.

Though in the aforementioned embodiment the spacer 6 is provided with the two pairs of projections 23, the spacer according to the present invention may be provided at least a pair of projections.

It should be noted that the aforementioned embodiment is anything more than to show the typical embodiment, the present invention is not limited within the embodiment. Namely, various modifications can be made without departing from the scope of the invention.

REFERENCE SIGNS LIST

1 connector
2 terminal fitting
3 housing
4 rear holder
5 rubber closure
6 spacer
8 electric wire
10 electric wire connection part
11 electric contact
12 flange
14 terminal housing
15 first housing
16 second housing
17 step face
21 main body
23 projection

The invention claimed is:

1. A connector comprising:

(a) a terminal fitting provided with an electric contact adapted to be connected with a mating terminal fitting and an electric wire connection part connected with an electric wire, the electric wire connection part having a flange projecting from outside of the electric wire connection part;

(b) a housing provided with a terminal housing accommodating the terminal fitting, the terminal housing having (i) a first housing accommodating the electric wire connection part, an end of the electric wire connected with the electric wire connection part;

(ii) a second housing extending to the first housing; and (iii) a step face formed between the first housing and the second housing, wherein the electric wire connection part is contactable with the step face;

(c) a rear holder attached to an end of the housing so as to prevent the terminal fitting from dropping out from the terminal housing;

(d) a rubber closure attached to outside of the electric wire and press-fitted into the terminal housing; and (e) a synthetic resin spacer accommodated in the first housing of the terminal housing, the spacer being arranged between the flange and the rubber closure, and the spacer comprising:

(i) a main body shaped circular in cross-section and positioning the electric wire connection part and the electric wire therewithin, and (ii) at least a pair of projections projecting from an inner surface of the main body and opposing to each other, wherein a gap between the at least pair of projections is smaller than a diameter of the electric wire, diametrical portions of the electric wire connection part and the electric wire are positioned within the main body of the spacer in an assembly state, and the diametrical portions of the electric wire connection part and the electric wire are passed through between the at least pair of projections while the gap between the at least pair of projections is broadened, and wherein the main body of the spacer is in a cylindrical shape with a cutaway formed along an axial direction of the main body, and each pair of projections is formed on an edge of the cutaway facing each other.

2. The connector as claimed in claim 1, further comprising a gasket attached to outside of the flange and waterproofing between outside of the flange and inside of the first housing.

3. The connector as claimed in claim 1, wherein the main body of the spacer is in a cylindrical shape with a C-shape cross-section.

* * * * *